US007202768B1

(12) United States Patent
Harvey et al.

(10) Patent No.: US 7,202,768 B1
(45) Date of Patent: Apr. 10, 2007

(54) TUNABLE INDUCTOR

(75) Inventors: Jackson Harvey, Maple Grove, MN (US); Prashant Rawat, Blaine, MN (US)

(73) Assignee: DSP Group Inc., Santa Clara, CA (US)

( * ) Notice: Subject to any disclaimer, the term of this patent is extended or adjusted under 35 U.S.C. 154(b) by 10 days.

(21) Appl. No.: 11/009,512

(22) Filed: Dec. 10, 2004

Related U.S. Application Data

(60) Provisional application No. 60/528,507, filed on Dec. 10, 2003.

(51) Int. Cl.
*H01F 27/28* (2006.01)

(52) U.S. Cl. ..... 336/232; 333/174

(58) Field of Classification Search ..... 336/232
See application file for complete search history.

(56) References Cited

U.S. PATENT DOCUMENTS 4,777,824 A * 10/1988 Alers et al. ..... 73/643
4,887,033 A * 12/1989 Langdon et al. ..... 324/253
5,461,353 A 10/1995 Eberhardt
5,872,489 A 2/1999 Chang et al.
6,501,267 B1 * 12/2002 Kurokawa et al. ..... 324/242
6,549,096 B2 * 4/2003 Groves et al. ..... 333/174
6,573,822 B2 * 6/2003 Ma et al. ..... 336/223
2002/0097153 A1 7/2002 Youbok et al.
2004/0066236 A1 4/2004 Fujimoto et al.
2004/0140528 A1 7/2004 Kim et al.

* cited by examiner

*Primary Examiner*—Elvin Enad
*Assistant Examiner*—Joselito Baisa

(57) ABSTRACT

In general, the invention is directed to a tunable inductor that makes use of eddy current effect to tune the inductance of an inductor. The tunable inductor may include a spiral or helical inductor in proximity to one or more sets of eddy current coils. Each eddy current coil may be coupled to a corresponding switch that controls whether the eddy current coil is grounded or floating. In operation, a first time-varying current through the inductor induces a first magnetic field that, in turn, induces a time-varying voltage in an eddy current coil. If the eddy current coil is not grounded, an eddy current flows through the eddy current coil. The eddy current, which flows in the opposite direction of the first time-varying current, induces a second magnetic field. The second magnetic field, which opposes the first magnetic field, reduces the inductance of the tunable inductor.

14 Claims, 5 Drawing Sheets

TUNABLE INDUCTOR

This application claims the benefit of U.S. provisional patent application No. 60/528,507, filed Dec. 10, 2003, the entire content of which is incorporated herein by reference.

TECHNICAL FIELD

The invention relates to inductors including inductors useful in inductor-capacitor (LC) tanks for radio frequency (RF) communication.

BACKGROUND

An inductor is an electrical device that introduces inductance into a circuit or functions by inductance within a circuit. In some applications, it is useful for inductors to be tunable. For example, circuits designed for RF applications may benefit by using tunable inductors. In particular, tuned circuits that include LC tanks used for loads, filters, impedance matching, or the like may use tunable inductors for tuning center frequencies.

The center frequency of an LC tank may be tuned for various reasons. For example, tuning the center frequency of LC tanks may compensate for process variation. In other cases, tuning the center frequency may track a signal frequency that varies. In addition, tuning the center frequency of an LC tank can produce a particular amplitude or phase for a given frequency.

A tunable inductor, having an inductance that may be controlled manually or automatically, typically is tunable only by mechanical means. Variable capacitors, also known as varactors, are sometimes used to tune LC tanks. If a varactor is grounded, banks of switched capacitors may be necessary to properly tune an LC tank.

SUMMARY

In general, the invention is directed to a tunable inductor that employs eddy current effects to tune the inductance of an inductor. The tunable inductor may include a spiral or helical inductor in proximity to one or more sets of eddy current coils. In particular, a set of eddy current coils may be above, below, or on the same plane as the inductor. Each eddy current coil may be coupled to a corresponding switch that controls whether the respective eddy current coil is grounded or floating.

In operation, a first time-varying current through the inductor may induce a first magnetic field that in turn induces a time-varying voltage in an eddy current coil. If the eddy current coil is grounded, no eddy current flows through the eddy current coil and the inductance of the tunable inductor remains unchanged.

If the eddy current coil is not grounded, however, an eddy current flows through the eddy current coil. The eddy current, which flows in the opposite direction of the first time-varying current, induces a second magnetic field. The second magnetic field, which opposes the first magnetic field, reduces the inductance of the tunable inductor.

The direction and amplitude of the second magnetic field may be controlled in order to tune the inductance of the inductor. In particular, the direction and amplitude of the second magnetic field may be controlled based on an arrangement of eddy current coils that are not grounded. By selectively coupling and decoupling one or more eddy current coils to ground, the inductance of the inductor can be selectively tuned.

In one embodiment, the invention is directed to a tunable inductor that includes an inductor, a first eddy current coil in proximity to the inductor, and a switch coupled to the first eddy current coil that controls whether the first eddy current coil is grounded or floating. The inductor has a standard inductance, wherein current through the inductor induces a first magnetic field. The first eddy current coil is capable of carrying an eddy current induced by the magnetic field. The inductance of the inductor can be tuned down from a standard inductance when the first eddy current coil is floating. Alternatively, the inductance of the inductor can be tune upward from a standard inductance when the first eddy current coil is grounded.

In another embodiment, the invention provides a tunable inductor comprising an inductor that induces a magnetic field in response to current flowing through the inductor, an eddy current coil in proximity to the inductor, and a switch to couple the eddy current coil to ground to prevent eddy current from flowing within the eddy current coil in response to the magnetic field, and to decouple the eddy current coil from ground to permit the eddy current to flow within the eddy current coil in response to the magnetic field, wherein the eddy current reduces an effective inductance of the inductor.

In a further embodiment, the invention provides a method for tuning an inductor, wherein the inductor induces a magnetic field in response to current flowing through the inductor. The method comprises coupling an eddy current coil to ground to prevent eddy current from flowing within the eddy current coil in response to the magnetic field, and decoupling the eddy current coil from ground to permit the eddy current to flow within the eddy current coil in response to the magnetic field, wherein the eddy current coil is in proximity to the inductor, and the eddy current reduces an effective inductance of the inductor.

The invention may provide one or more advantages. A variable tank capacitance can cause degradation of linearity or Q. However, a tunable inductor in accordance with the invention can help to avoid these disadvantages. Moreover, the invention provides a technique for tuning an inductor by non-mechanical means. In addition, varactors, which can bring nonlinearity to a system, are not necessary for implementing the invention. Furthermore, banks of switches, which contain resistances that can degrade the Q and performance of the tank, are not detrimental to the circuit. In particular, the degradation of the inductor Q is minimized because the switches are not in place when eddy current flows, and the switches are not in the signal path.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
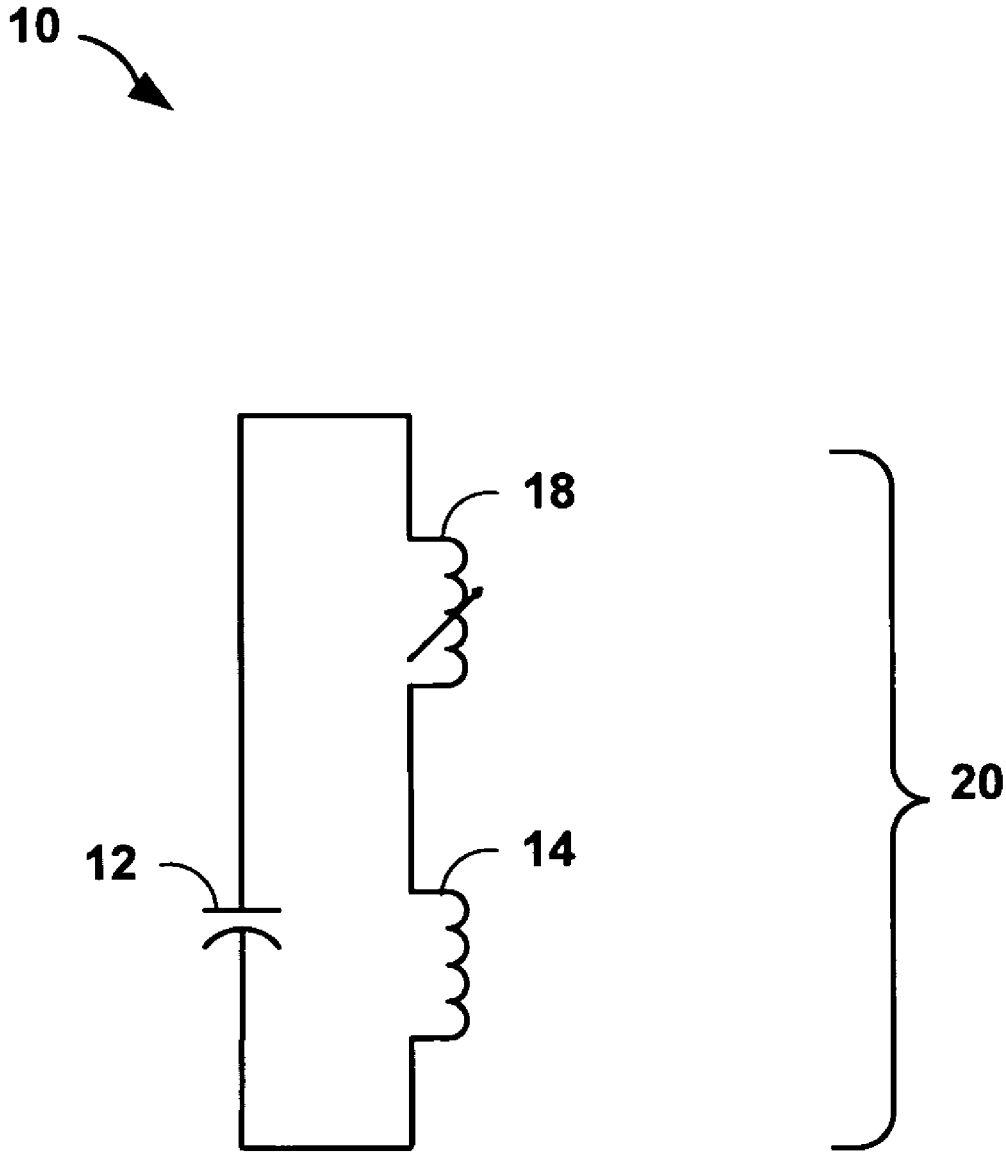
FIG. 1 is a schematic diagram illustrating an LC tank that includes an exemplary tunable inductor.

FIG. 1 is a schematic diagram illustrating an LC tank 10 that includes a capacitor 12 and an exemplary tunable inductor 20. In particular, tunable inductor 20 includes an inductor 14 and a virtual inductor 18. Inductor 14 may be a helical inductor, a spiral inductor, or the like. A helical inductor may be classified as a substantially 3-dimensional structure, whereas a spiral inductor is a substantially 2-dimensional structure. Inductor 14 has a standard inductance, such that current through the inductor induces a first magnetic field.

Virtual inductor 18 may have a variable inductance that is adjustable. In one embodiment, the inductance of virtual inductor 18 acts as a negative inductance, thereby reducing the inductance of tunable inductor 20. The inductance of virtual inductor 18 may be induced by techniques described below. For example, virtual inductor 18 may include one or more eddy current coils. A current flowing through the eddy current coils may induce a second magnetic field that opposes the first magnetic field.

Figure 2:
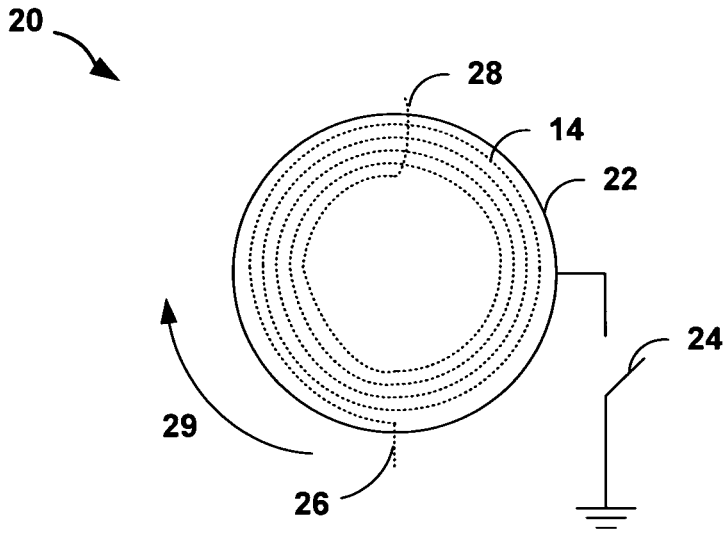
FIG. 2 is a conceptual diagram illustrating a top view of an exemplary tunable inductor.

FIG. 2 is a conceptual diagram illustrating a top view of an exemplary tunable inductor 20. Tunable inductor 20 includes an inductor 14 and at least one set of eddy current coils 22. Inductor 14 is shown in FIG. 2, by dotted line, as a spiral inductor with an inductor input 26 and an inductor output 28. Inductor 14 has a standard inductance that may be tuned as described below. Only one eddy current coil 22 is shown in FIG. 2. Eddy current coil 22 may include a conductive metal ring. In one embodiment, the eddy current coil 22 may be in the same plane as inductor 14. In other embodiments described below, an eddy current coil may be formed in a plane above or below inductor 14. Eddy current coil 22 and inductor 14 may be formed from similar electrically conductive materials, such as copper. In addition, eddy current coil 22 and inductor 14 may be formed as conductive traces or windings.

The eddy current coil 24 may be coupled to a corresponding switch 24 that controls whether the eddy current coil is grounded or floating. Switch 24 may be a transistor, a relay, a microelectromechanical switch, or the like. In one embodiment, an NMOS transistor is used for the switch 24. Eddy current coil 24 may carry eddy current that is induced by a changing magnetic field. The eddy current may produce heat, which can lower the efficiency of inductor 14.

In operation, a first time-varying current through the inductor 14 induces a first magnetic field that in turn induces a time-varying voltage in eddy current coil 22. For example, the first time-varying current in inductor 14 may flow in the clockwise direction indicated by reference numeral 29. The current induces a magnetic field in a direction into the page in FIG. 2, i.e., normal to the major plane of inductor 14.

If the eddy current coil 22 is grounded, no eddy current flows through the eddy current coil and the inductance of the tunable inductor 14 remains unchanged. However, if the eddy current coil 22 is not grounded, an eddy current flows through the eddy current coil. The eddy current, which flows in the opposite direction of the first time-varying current, induces a second magnetic field. The second magnetic field, which opposes the first magnetic field, reduces the inductance of the tunable inductor 14.

Accordingly, in a "normal" state of inductor 14, eddy current does not flow through eddy current coil 22, and the inductance of inductor 14 is generally unchanged. In this normal state of inductor 14, eddy current coil is grounded so that no eddy current flows. to achieve a reduced inductance state, eddy current coil 22 is decoupled from ground and allowed to float. In this reduced inductance state, the eddy current flowing through eddy current coil 22 reduces the inductance of inductor 14. The normal state and reduced inductance state may be selected by closing or opening switch 24, respectively. In this manner, the inductance of inductor 14 can be manipulated on a selected basis.

Alternatively, in other embodiments, the opposite arrangement may be used, such that the normal state of the inductor 14 is a reduced inductance state in which eddy current flows through a floating eddy current coil 22. In this case, an increased inductance state can be achieved in inductor 14 by coupling eddy current coil 22 to ground via switch 24, and thereby stopping the flow of eddy current.

Because eddy current can produce heat, it may be desirable to configure the normal state of the inductor 14 so that no eddy current flows. The power that is lost due to heat is signal power, which can lead to a degradation in performance. For example, a Q factor may be degraded due to the loss of signal power. Accordingly, for power efficiency, inductor 14 may occupy a normal state in which no eddy current flows through eddy current coil 22. In this case, switch 24 is controlled to couple eddy current coil 22 to ground and activate a reduced inductance state.

The amplitude of the second magnetic field induced by the current flowing through the eddy current coil 22, or multiple eddy current coils 22, may be controlled in order to tune the inductance of the inductor 14. Arranging sets of eddy current coils, and manipulating individual switches that connect the eddy current coils to ground may be used to control the amplitude of the second magnetic field with finer granularity. The changing second magnetic field directly affects the inductance of tunable inductor 20.

Figure 3:
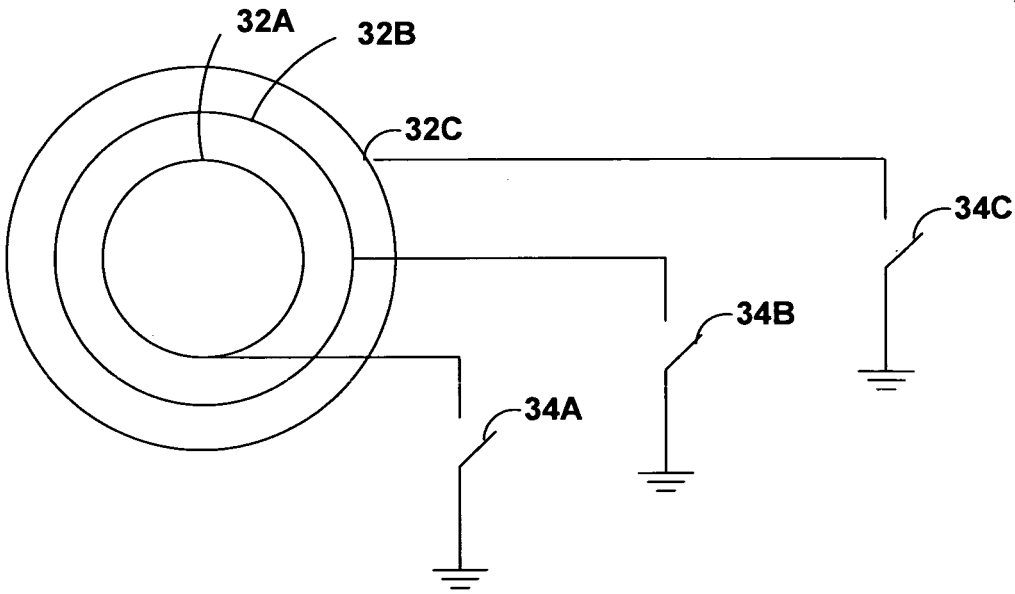
FIG. 3 is a conceptual diagram illustrating a top view of tunable inductor parts that may be used for generating or inhibiting an eddy current.

FIG. 3 is a conceptual diagram illustrating a top view of a set tunable inductor components that may be used for generating an eddy current. In particular, FIG. 3 illustrates eddy current coils 32A, 32B, 32C (collectively, "eddy current coils 32"), and switches 34A, 34B, and 34C (collectively, "switches 34"), which may be selectively opened and closed to couple one or more of eddy current coils 32 to ground. Eddy current coils 32 may be on a single plane and may make up a set of eddy current coils.

In the example of FIG. 3, eddy current coils 32 are formed concentrically. Concentric eddy current coils 32 may be above, below, or on the same plane as inductor 14. In one embodiment, each of eddy current coils 32 may correspond to a loop of inductor 14. Each of eddy current coils 32 may correspond to one of switches 34, such that each switch individually controls connection of one of the eddy current coils to ground.

Depending on the states of the switches 34, i.e., i.e. open or closed, inductor 14 will induce eddy current in none, one, two, or all eddy current coils 32. For example, when switch 34A is open, the corresponding eddy current coil 32A floats, allowing eddy current to flow through the eddy current coil 32A. As eddy current flows through eddy current coil 32A, the inductance of the inductor 14 is reduced. In another example, when switch 34B is closed, a corresponding eddy current coil 32B is grounded, preventing eddy current from flowing through the eddy current coil 32B. With no eddy current flowing through the eddy current coil 32B, the inductance of the inductor 14 is maintained at a normal level.

Eddy current coils 32A, 32B, 32C may have different diameters, occupy different positions, and even be constructed with different conductive materials or different amounts of such materials. As a result, each individual eddy current coil 32 may produce a different magnitude of eddy current. With three different eddy current coils 32A, 32B, 32C and three respective switches 34A, 34B, 34C, the eddy current coils may provide eight different tuning states for inductor 14 as indicated in TABLE 1 below.

TABLE 1

| Tuning State | Conditions |
|---|---|
| 1 | All three eddy current coils coupled to ground |
| 2 | Eddy current coil 32A floating, coils 32B, 32C coupled to ground |
| 3 | Eddy current coil 32B floating, coils 32A, 32C coupled to ground |
| 4 | Eddy current coil 32C floating, coils 32A, 32B coupled to ground |
| 5 | Eddy current coils 32A and 32B floating, coil 32C coupled to ground |
| 6 | Eddy current coil 32A and 32C floating, coils 32B coupled to ground |
| 7 | Eddy current coil 32B and 32C floating, coil 32A coupled to ground |
| 8 | All three eddy current coils 32B floating. |

Each of switches 34 also may be manipulated to control the direction and amplitude of the second magnetic field described above with reference to FIG. 2. In addition, although three eddy current coils 32 are shown in FIG. 3, a greater or lesser number of eddy current coils and corresponding switches may be used. Furthermore, additional sets of eddy current coils, like the set comprising eddy current coils 32A, 32B, 32C, may be used to affect the second magnetic field. The changing second magnetic field directly affects the inductance of tunable inductor 20.

Figure 4:
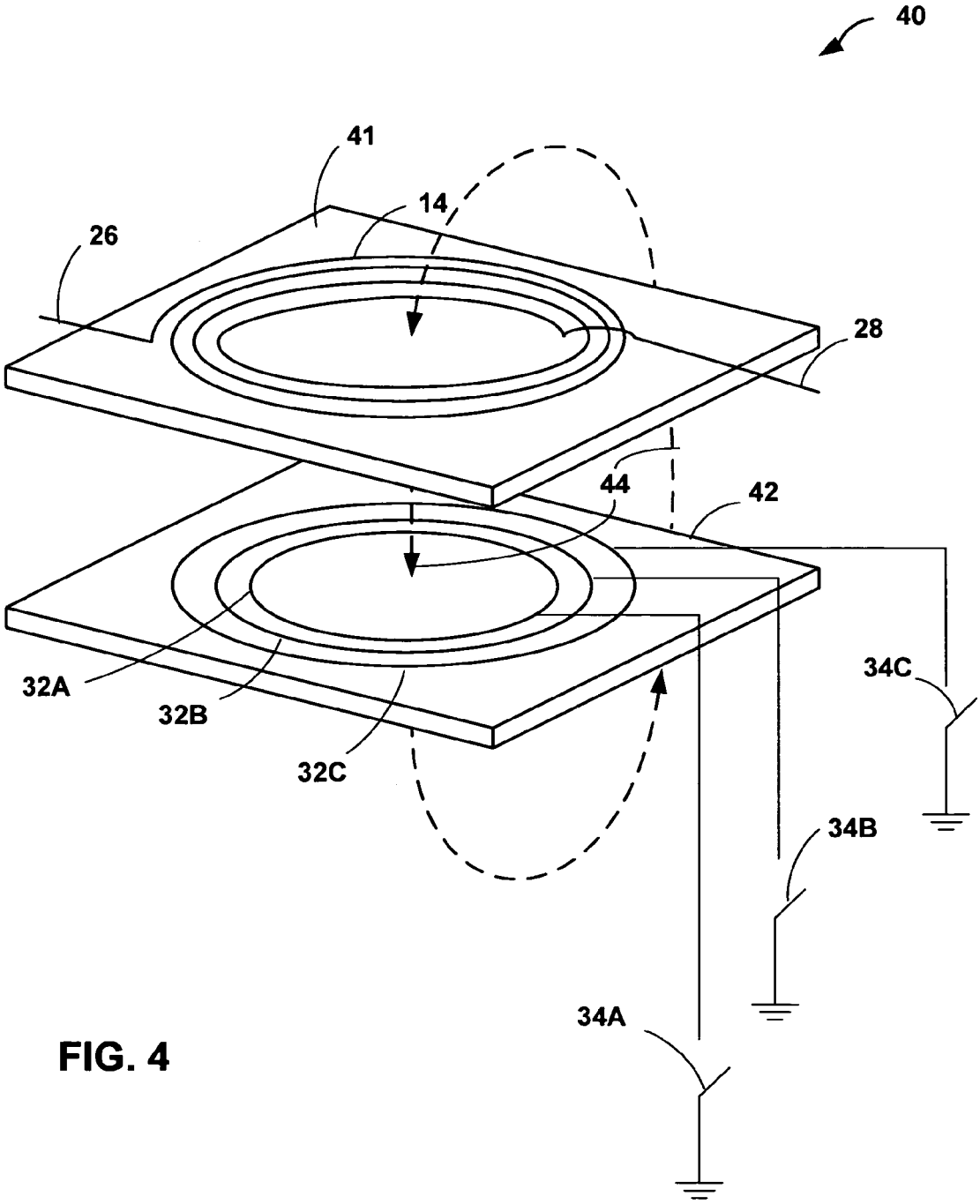
FIG. 4 is a perspective diagram illustrating an exemplary tunable inductor.

FIG. 4 is a perspective diagram illustrating an exemplary tunable inductor 40. Tunable inductor 40 includes inductor 14, eddy current coils 32A, 32B, 32C (collectively, "eddy current coils 32"), and switches 34A, 34B, and 34C (collectively, "switches 34"). Inductor 14 may be a spiral inductor on plane 41. As shown in FIG. 4, eddy current coils 32 may be on a single plane 42 and may make up a set of eddy current coils 32. In various embodiments, concentric eddy current coils 32 may be above, below, or on the same plane as inductor 14. In the example of FIG. 4, eddy current coils 32 are on a different plane from inductor 14. A dielectric layer may be formed between planes 41, 42. In one embodiment, each of eddy current coils 32 may correspond to a loop of inductor 14. Each of eddy current coils 32 may correspond to one of switches 34.

In operations, a first time-varying current through the inductor 14 induces a first magnetic field that in turn induces a time-varying voltage in eddy current coils 32. For example, the first time-varying current in inductor 14 may flow in the clockwise direction. The current induces a first magnetic field 44.

If an eddy current coil, such as eddy current coil 32A, is grounded, no eddy current flows through the eddy current coil 32A and the inductance of the tunable inductor 40 remains unchanged. However, if the eddy current coil 32A is not grounded, an eddy current flows through the eddy current coil 34A. The eddy current, which flows in the opposite direction of the first time-varying current, induces a second magnetic field. The second magnetic field, which opposes the first magnetic field 44A, reduces the inductance of the tunable inductor 40.

The direction and amplitude of the second magnetic field may be controlled in order to tune the inductance of the inductor 14. In particular, switches 34 that connect the eddy current coils 32 to ground may be manipulated on a selective basis to control the amplitude of the second magnetic field. In addition, sets of eddy current coils 32 may be arranged in various configurations to control the second magnetic field.

Figure 5:
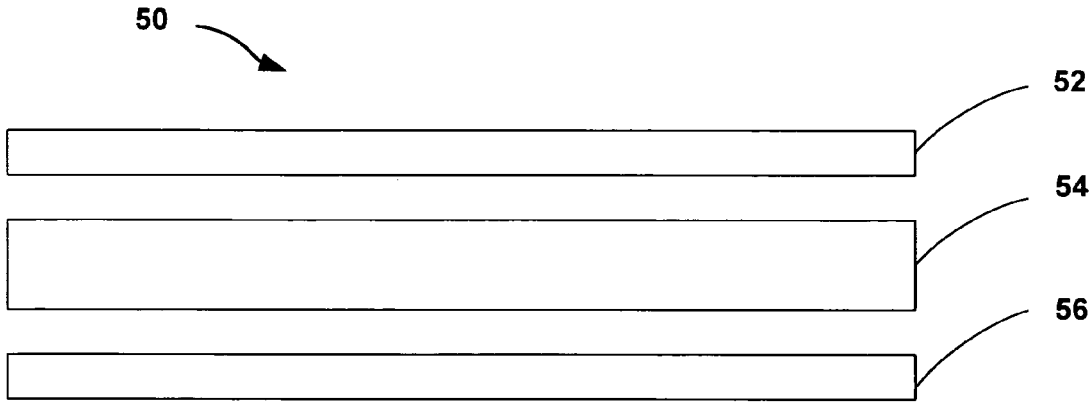
FIG. 5 is a conceptual diagram illustrating a side view of an exemplary tunable inductor.

FIG. 5 is a conceptual diagram illustrating a side view of an exemplary tunable inductor 50. As described above, tunable inductor 50 may include an inductor 54, a first set of eddy current coils 52 that is above inductor 54, and a second set of eddy current coils 56 that is below inductor 54. For simplicity, the switches that ground the eddy current coils in sets of eddy current coils 52, 56 are not shown in FIG. 5. Each set of eddy current coils 52, 56 may include one or more eddy current coils. In one embodiment, each set of eddy current coils 52, 56 may correspond to a loop of inductor 14. Inductor 54 and eddy current coils 52, 56 may be formed in an integrated multi-layer circuit structure using conventional circuit printing or deposition processes. Switches to selectively connect eddy current coils 52, 56 to ground may also be formed on one of the planes of the multi-layer circuit structure, e.g., as thin film transistor devices, such as NMOS field effect transistors. Alternatively, switches may be formed as microelectromechanical switches or relays. One or more capacitors also may be formed in the multi-layer circuit structure to form an LC tank in conjunction with tunable inductor 50.

Figure 6:
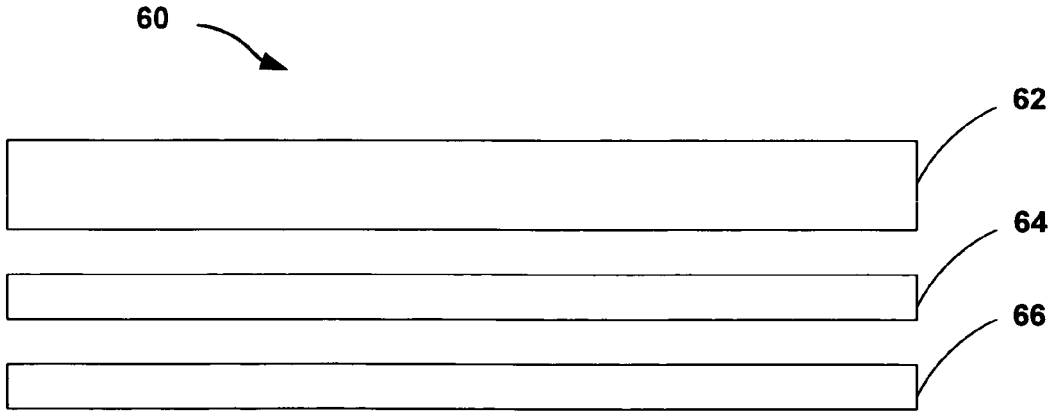
FIG. 6 is a conceptual diagram illustrating a side view of an alternative tunable inductor.

FIG. 6 is a conceptual diagram illustrating a side view of an alternative tunable inductor 60. As described above, tunable inductor 60 may include an inductor 62, a first set of eddy current coils 64 below inductor 62, and a second set of eddy current coils 66 that is below inductor 62. Inductor 62 and eddy current coils 64, 66 may be formed in a multi-layer circuit structure. For simplicity, the switches that ground the eddy current coils in sets of eddy current coils 64, 66 are not shown in FIG. 5. However, such switches may be formed on the same planes as eddy current coils 64, 66, or on a different plane of the multi-layer circuit structure. Each set of eddy current coils 64, 66 may include one or more eddy current coils. In one embodiment, each set of eddy current coils 64, 66 may correspond to a loop of inductor 14. The multi-layer circuit structure also may include one or more capacitors to form an LC tank.

Figure 7:
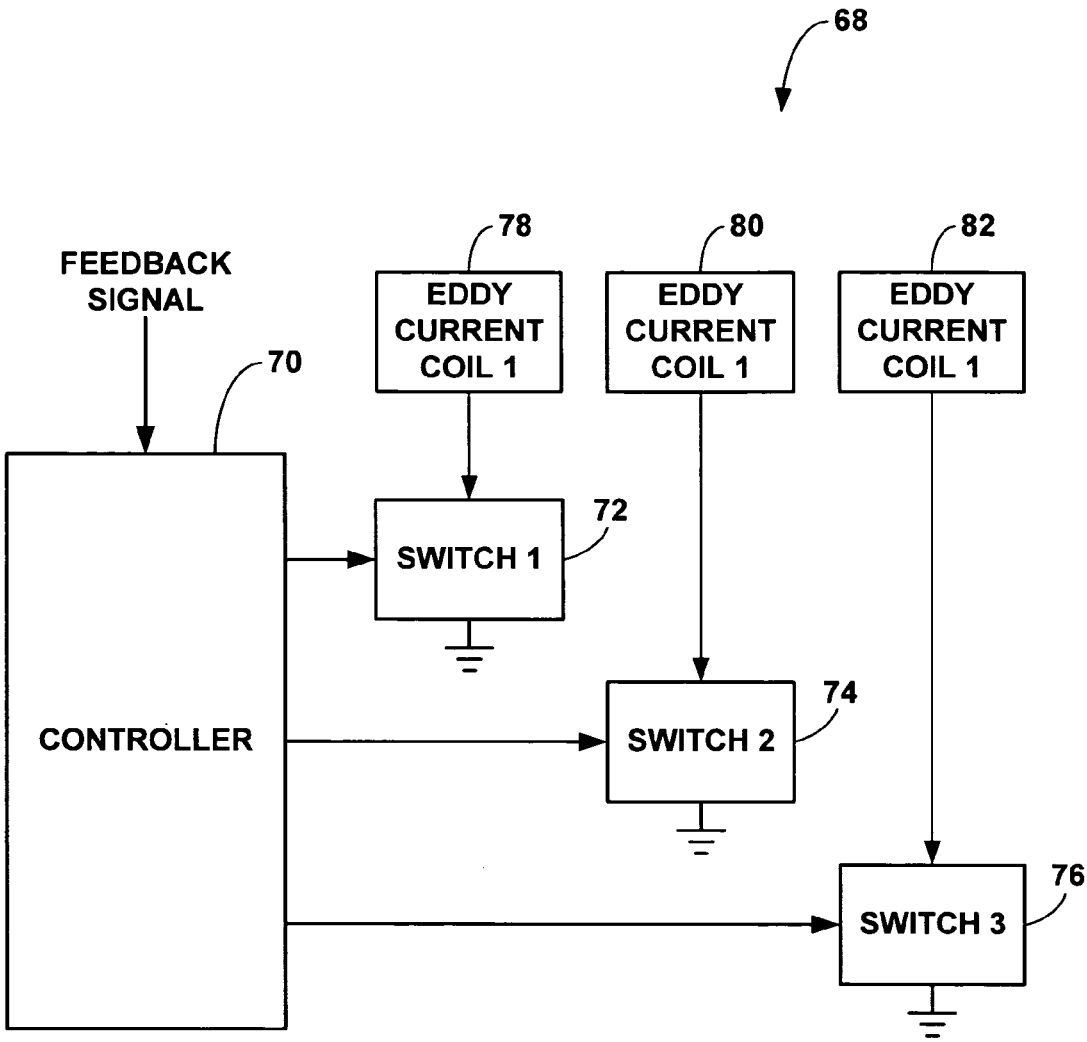
FIG. 7 is a block diagram illustrating a system for tuning a tunable inductor as described herein.

FIG. 7 is a block diagram illustrating a system 68 for tuning a tunable inductor as described herein. The multi-layer circuit structures depicted in FIGS. 5 and 6 may form part of a larger circuit, such as a receiver or transmitter circuit, e.g., for radio frequency (RF) telecommunication. Accordingly, the tunable inductor may have an appropriate input and output for use in such a circuit. In some embodiments, the tunable inductor may be configured at the factory to achieve a desired inductance. In particular, the switches can be closed or opened on a selective basis to achieve desired inductance.

Also, in some embodiments, the tunable inductor may be dynamically controlled by a circuit in which the tunable inductor is used. As shown in FIG. 7, a controller 70 may be provided to control switches 72, 74, 76 and thereby selectively couple individual eddy current coils to 78, 80, 82 to ground. Controller 70 may be responsive to a feedback signal that indicates a need for adjustment of the tunable inductor.

The feedback signal may indicate that a step adjustment is necessary. In this case, controller 70 may continue to incrementally increase or decrease inductance by closing or opening the switches 72, 74, 76, e.g., one at a time. Alternatively, the feedback signal may actually indicate a desired magnitude of the adjustment, in which case controller 70 may selectively control one or more switches simultaneously to achieve the desired inductance.

Various embodiments of the invention have been described. In other embodiments, the invention also may contemplate methods for fabricating a tunable inductor. These and other embodiments are within the scope of the following claims.

The invention claimed is:

1. A tunable inductor comprising:

an inductor that induces a magnetic field in response to current flowing through the inductor;

a first eddy current coil in proximity to the inductor;

a first switch to couple the first eddy current coil to ground to prevent eddy current from flowing within the first eddy current coil in response to the magnetic field, and to decouple the first eddy current coil from ground to permit the eddy current to flow within the first eddy current coil in response to the magnetic field, wherein the first eddy current reduces an effective inductance of the inductor a second eddy current coil in proximity to the inductor, wherein the first eddy current coil and the second eddy current coil are on opposite sides of the inductor;

a second switch to couple the second eddy current coil to ground to prevent eddy current from flowing within the second eddy current coil in response to the magnetic field, and to decouple the second eddy current coil from ground to permit the eddy current to flow within the second eddy current coil in response to the magnetic field, wherein the eddy current flowing in the second eddy current coil reduces an effective inductance of the inductor.

2. The tunable inductor of claim 1, wherein the first switch includes a NMOS transistor.

3. The tunable inductor of claim 1, wherein the first switch includes a microelectromechanical switch.

4. The tunable inductor of claim 1, wherein the inductor is a spiral inductor.

5. The tunable inductor of claim 1, wherein the inductor is a helical inductor.

6. The tunable inductor of claim 1, wherein the inductor, the first eddy current coil, and the second eddy current coil reside on different planes, wherein the planes of the first eddy current coil and the second eddy current coil are parallel with the plane of the inductor.

7. The tunable inductor of claim 1, further comprising a controller to control the first and second switches to selectively couple and decouple the first and second eddy current coils relative to ground to adjust the effective inductance of the inductor.

8. The tunable inductor of claim 1, wherein the first eddy coil includes a conductive ring.

9. A method for tuning an inductor, wherein the inductor induces a magnetic field in response to current flowing through the inductor, the method comprising:

coupling a first eddy current coil to ground to prevent eddy current from flowing within the first eddy current coil in response to the magnetic field;

decoupling the eddy current coil from ground to permit the eddy current to flow within the eddy current coil in response to the magnetic field, wherein the eddy current coil is in proximity to the inductor, and the eddy current reduces an effective inductance of the inductor;

coupling a second eddy current coil to ground to prevent eddy current from flowing within the eddy current coil in response to the magnetic field; and decoupling the second eddy current coil from ground to permit the eddy current to flow within the second eddy current coil in response to the magnetic field, wherein the second eddy current coil is in proximity to the inductor, the first eddy current coil and the second eddy current coil are on opposite sides of the inductor, and the eddy current flowing in the second eddy current coil reduces an effective inductance of the inductor.

10. The method of claim 9, wherein the inductor is a spiral inductor.

11. The method of claim 9, wherein the inductor is a helical inductor.

12. The method of claim 9, wherein the inductor, the first eddy current coil, and the second eddy current coil reside on different planes, wherein the planes of the first eddy current coil and the second eddy current coil are parallel with the plane of the inductor.

13. The method of claim 9, further comprising:

coupling a third eddy current coil to ground to prevent eddy current from flowing within the third eddy current coil in response to the magnetic field; and decoupling the third eddy current coil from ground to permit the eddy current to flow within the third eddy current coil in response to the magnetic field, wherein the third eddy current coil is in proximity to the inductor, and the eddy current flowing in the third eddy current coil reduces an effective inductance of the inductor.

14. The method of claim 9, wherein the first eddy coil includes a conductive ring.

* * * * *